US005875990A

United States Patent [19]

Svanqvist et al.

[11] Patent Number: 5,875,990

[45] Date of Patent: Mar. 2, 1999

[54] REEL-UP

[75] Inventors: Tord Olof Sixten Svanqvist; Sture Erling Leon Svensson; Lars-Erik Roland Önnerlöv, all of Karlstad, Sweden

[73] Assignee: Valmet-Karlstad AB, Karlstad, Sweden

[21] Appl. No.: 991,280

[22] Filed: Dec. 16, 1997

Related U.S. Application Data

[60] Provisional application No. 60/039,520 Mar. 3, 1997.

[30] Foreign Application Priority Data

Dec. 16, 1996 [SE] Sweden ..... 9604607

[51] Int. Cl.[6] ..... B65H 18/16

[52] U.S. Cl. ..... 242/542.3; 242/541.1; 242/541.5

[58] Field of Search ..... 242/542.3, 541.1, 242/541.5, 541.6

[56] References Cited

U.S. PATENT DOCUMENTS

| | | | |
|---|---|---|---|
| 3,614,011 | 10/1971 | Karr . | |
| 3,834,642 | 9/1974 | Kampf . | |
| 4,143,828 | 3/1979 | Braun et al. . | |
| 4,175,714 | 11/1979 | Dreher . | |
| 4,283,023 | 8/1981 | Braun et al. . | |
| 4,934,619 | 6/1990 | Snygg . | |
| 5,370,327 | 12/1994 | Adamski . | |
| 5,375,790 | 12/1994 | Svanqvist . | |
| 5,393,008 | 2/1995 | Kyytsönen et al. . | |
| 5,520,354 | 5/1996 | Adamski . | |
| 5,531,396 | 7/1996 | Kinnunen et al. | 242/526.3 |
| 5,544,841 | 8/1996 | Didier et al. | 242/541.1 |
| 5,560,566 | 10/1996 | Bagnato | 242/541.1 |
| 5,577,685 | 11/1996 | Junk . | |
| 5,673,870 | 10/1997 | Fielding et al. . | |
| 5,816,528 | 10/1998 | Ekstrom et al. | 242/541.5 |

FOREIGN PATENT DOCUMENTS

| | | |
|---|---|---|
| 44 01 959 | 7/1994 | Germany . |
| WO 94/26641 | 11/1994 | WIPO . |
| WO 96/15059 | 5/1996 | WIPO . |

*Primary Examiner*—John P. Darling
*Attorney, Agent, or Firm*—Bell Seltzer Intellectual Property Law Group of Alston & Bird LLP

[57] ABSTRACT

A reel-up in which paper is reeled up on reeling drums to form paper reels, said reel-up comprising two stand members each having a stand rail to support the reeling drum; a surface winding mechanism over which the web runs; and a secondary system with at least one secondary unit for receipt of a reeling drum, wherein the secondary unit comprises first and second secondary bodies which are linearly movably journalled in said stand members. According to the invention each secondary body comprises a lifting mechanism for lifting the reeling drum from the stand rail to a production level in which the reeling drum is free from the stand rails and the load of the paper reel and the reeling drum is taken up by the secondary bodies and transferred to the stand members. The lifting mechanism comprises a top rail with an upper support surface parallel to the adjacent stand rail, and at least one actuator to bring the support surface of the top rail into contact with the reeling drum and effect the lifting through vertical movement of the top rail.

27 Claims, 11 Drawing Sheets

20
3
1
19
13
12a
4
50
49
12
8
39
10
23
11
9

22
54
34
50
38
26
12
7
36
52
39
51
71
26
72
23
73
41
35
27
28

REEL-UP

CROSS-REFERENCE TO RELATED APPLICATIONS

This application claims the benefit of U.S. Provisional Application Ser. No. 60/039,520, filed Mar. 3, 1997.

FIELD OF THE INVENTION

The present invention relates to papermaking machines and more particularly relates to reel-ups for reeling up a paper web as the web exits a papermaking machine.

BACKGROUND OF THE INVENTION

A plurality of different types of reel-ups exist for reeling a continuous paper web from a paper machine to a paper reel. These are usually designed with two separate systems in order to enable continuous production to be maintained, namely a primary system for receipt of an empty reeling drum from a pair of lowering arms upstream of the reel-up and, when the paper web has been wound a few turns, a secondary system which takes over the reeling drum with the beginnings of a paper reel for continued reeling to a finished reel of paper.

Examples of usual types of reel-ups are those in which the secondary system comprises either a pair of secondary arms or a pair of secondary carriages which are turned or displaced linearly depending on the increase in diameter of the paper reel. Reel-ups with secondary arms are described in the following patent specifications, for instance: U.S. Pat. Nos. 4,143,828, 4,283,023, 4,175,714, 3,614,011 and 5,520,354. Reel-ups with linearly movable secondary carriages are described in the following patent specifications, for instance: U.S. Pat. Nos. 4,934,619 and 5,370,327.

Another example is a slightly different and more modern type of reel-up which entirely lacks the primary system described above, but which is instead provided with double secondary units to replace said primary system. A reel-up of this type is described in U.S. Pat. No. 5,370,327.

In the present context we have chosen to use the prefix "secondary" in the terms "secondary system", "secondary unit", "secondary part", "secondary body", etc., even if the reel-up does not have a primary system.

In reel-ups of the first-mentioned type, i.e., with primary systems, reeling occurs briefly in the following way: An empty reeling drum is transferred from a stock of drums upstream of the reel-up to a pair of primary forks which bring it into contact with a driven surface winding drum over which the web runs, in order to initiate reeling of the web. Considerable friction thus occurs between the reeling drum and the surface winding drum, so that the reeling drum is generally first caused to rotate at the same speed as the surface winding drum before coming into contact with the drum.

The reeling drum is then moved along the periphery of the surface winding drum, down to horizontal stand members where secondary units in the form of secondary arms or secondary carriages take over control of the reeling drum. Continued reeling to a finished reel is achieved in that the secondary arms or secondary carriages, turning around a joint or being displaced linearly along the stand members, follow the horizontal movement of the reel caused by its increasing size. Press devices arranged on the secondary units, operate against bearing houses disposed on the end portions of the reeling drum so that a desired and adjustable linear pressure is maintained in the nip between the surface winding drum and the paper reel as it increases in size.

For certain grades of paper the linear pressure in the nip must be low in order to avoid negative properties in the paper reel. Too low a linear pressure will result in a risk that the individual layers in the reel will be wound too loosely. However, this problem can be solved by connecting the reeling drum to a central drive means with the aid of a coupling device disposed at one end of the reeling drum since the reeling drum no longer needs to be driven by the friction against the surface winding drum. Central driving also allows the linear pressure to be varied within a wider range so that the compression of the paper web in the nip between the paper reel and the surface winding drum can be reduced. Reel-ups with central driving are described in the following patent specifications, for instance: U.S. Pat. Nos. 4,934,619, 5,370,327, 5,520,354, 5,375,790 (SE-469 071) and 5,393,008 (SE-469 072).

When central driving is used for transferring the reeling drum from the primary system to the secondary system, a change of transmission must be effected between different drive devices, which affects the linear pressure due to a temporary pressure increase in the nip. To optimize reeling, the same driving may be connected throughout the reeling procedure from the start with an empty reeling drum, to finished reel. To achieve this it is previously known to use double sets of secondary carriages only, which alternate with each other and enable omission of the primary arms. In this way a single drive means connected to one of the carriage pairs can follow the reeling drum throughout the reeling process to a finished reel. A reel-up of this type is described in U.S. Pat. No. 5,370,327.

All these known reel-ups of various types, both with and without primary systems, suffer from another considerable common problem, namely that of undesired frictional forces. The reason these forces constitute such a great problem is that, as mentioned above, it is extremely important during the reeling procedure to be able to control the linear pressure in the nip between the surface winding drum and the growing paper reel as exactly as possible in order to avoid negative properties in the paper reel, particularly when reeling soft crepe paper such as "soft tissue" and similarly delicate paper used for sanitary purposes, which requires a low linear pressure. However, this control is made more difficult by said frictional forces. A reliable and correct control of the nip pressure thus requires a linear loading system with very little friction.

Undesired frictional forces arise, inter alia, due to friction in bearings and contact surfaces, friction in joints of the primary and secondary arms, press devices, etc. Friction may also arise in the hydraulic cylinders that move the secondary carriages. Every reel-up with secondary carriages also has one or more rails in its stand members, arranged to control the secondary carriage and to minimize the friction during the to and from movement of the secondary carriage. The latter is suitably effected through some form of bearings such as roller or slide bearings.

In a reel-up with a linear load system comprising horizontally movable secondary units for the reeling drum, it is the friction between the reeling drum and the stand rails, the stand-rail friction, which is responsible for the greatest limitation in accuracy and reliability in the control over the linear pressure in the reel nip. Even if the linear bearings of the secondary carriages are designed with very little friction, the stand-rail friction will be the same, regardless of any improvements in the bearings of the secondary carriage, i.e., unchanged high friction in this case, as long as the reel is supported by the stand rail during the production phase. Even in the case of very low frictional forces caused by the linear bearings, the stand-rail friction will still give relatively considerable negative effects on the properties of the paper reel, which may also affect the quality of the paper in other respects.

In the known reel-ups the reeling drum gives rise to at least three different cooperating frictional forces, namely a first friction in the bearing house caused by rotation of the reeling drum and by movement of the reeling drum along the stand rail as the reel increases in size, a second friction through abutment against the stand rail and finally a third friction in the linear bearings of the secondary carriage.

When the reeling drum runs along the stand rail during production of a new paper reel, there is a not negligible risk of obstacles in the form of foreign objects such as accumulated dust from the paper web, or deformities in the stand rail or the reeling drum, having a detrimental effect on the horizontal movement and causing temporary oscillations in the nip pressure due to the increased force that must be intermittently supplied to the actuators when the reeling drum encounters the obstacle, and this may have a negative effect on the paper reel. The uneven linear movement caused by said obstacles, including deformations in the form of surface damage to the stand rail, for instance, also gives rise to unfavorable vibrations, which affect the paper reel and in the long term may result in unnecessary wear on the bearing house of the reeling drum, for instance, and thus also on the coupling device for central driving of the reeling drum. When positioning the reeling drum along the stand as the paper reel increases in size, the stand friction constitutes an additional problem since it complicates the adjustments necessary for the actuators of the secondary unit.

SUMMARY OF THE INVENTION

The reel-up according to the invention provides a great advance in the art by substantially reducing the friction associated with a winding reel drum and eliminating friction induced by the stand rails. In particular, the present reel-up is characterized in that each secondary body, comprises a lifting means arranged to lift the reeling drum from the associated stand rail to a raised production level so that the reeling drum is free from the stand rails and the load of the paper reel and the reeling drum is taken up entirely by the secondary bodies and transferred from them to said stand means via said journalling means. The lifting means comprises a top rail which has an upper support surface and is parallel to the adjacent stand rail, and at least one actuator to bring the support surface of the top rail into contact with the reeling drum and effect said lifting movement through continued substantially vertical movement of the top rail.

The immediate advantage gained by raising the reeling drum from the stand is reduced total friction in the secondary system, thanks to the stand-rail friction having been eliminated. When the load from the paper reel is instead transferred only to the linear bearings of the secondary carriages the friction in these increases, but the total friction will still be lower overall since the friction in the linear bearings is lower than in the case of a corresponding direct contact between reeling drum and stand rail.

Horizontal positioning of the reeling drum depending on the growth of the paper reel will be easier to perform if it is raised by the secondary unit and is thus free from the stand rail since, as described above, the friction will be lower. The stand rails are retained for reasons of safety but they can very well be made of lower grade steel than the stand rails which support the reeling drum throughout the entire reeling phase. The invention will be described in more detail in the following with reference to the drawings.

BRIEF DESCRIPTION OF THE DRAWINGS

FIG. 16 is a side view of an inner support plate of the second secondary carriage according to FIG. 12.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
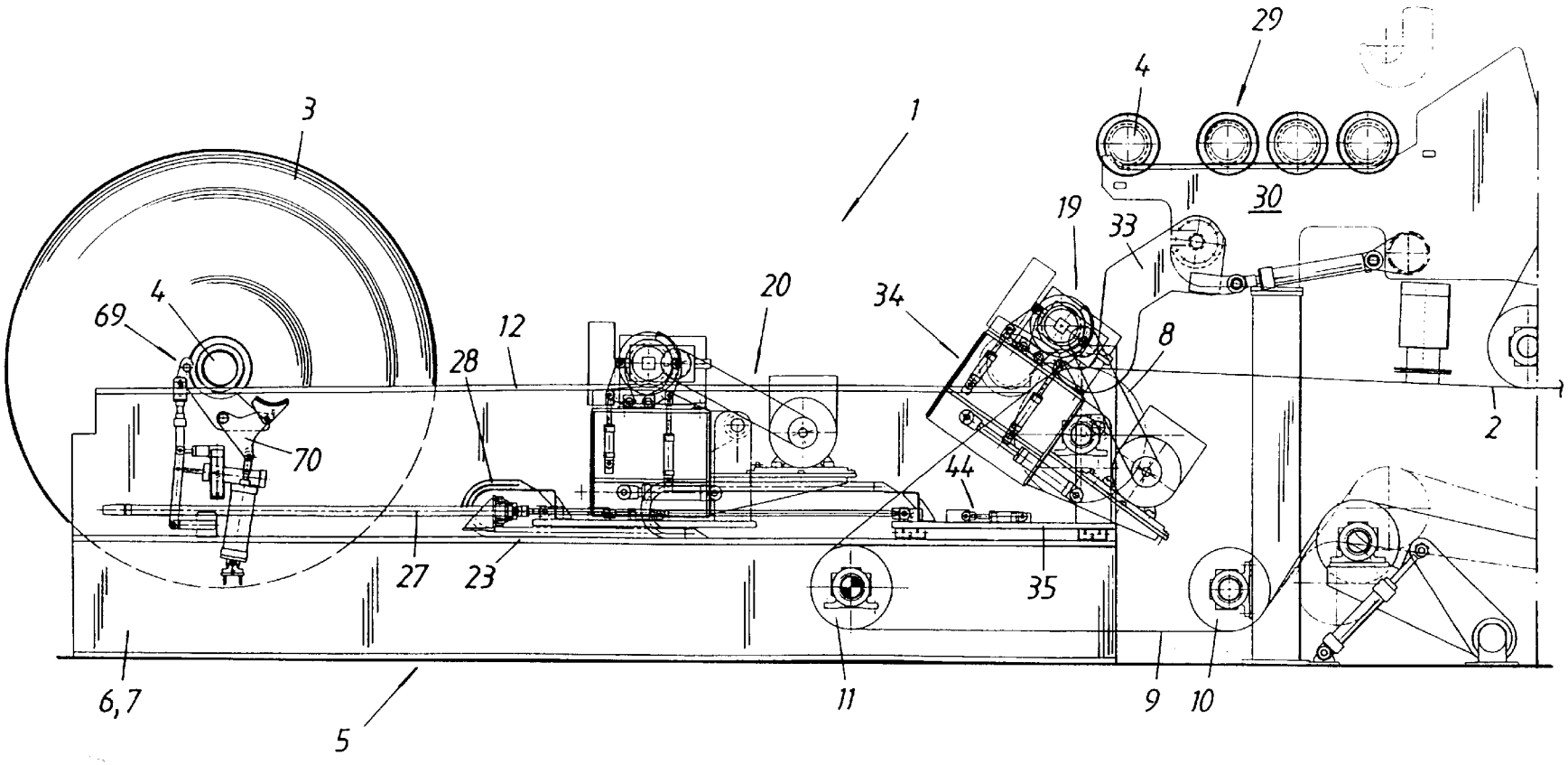
FIG. 1 is a side view of a reel-up with double secondary units and provided with lifting means in accordance with a first embodiment of the invention.
Figure 2:
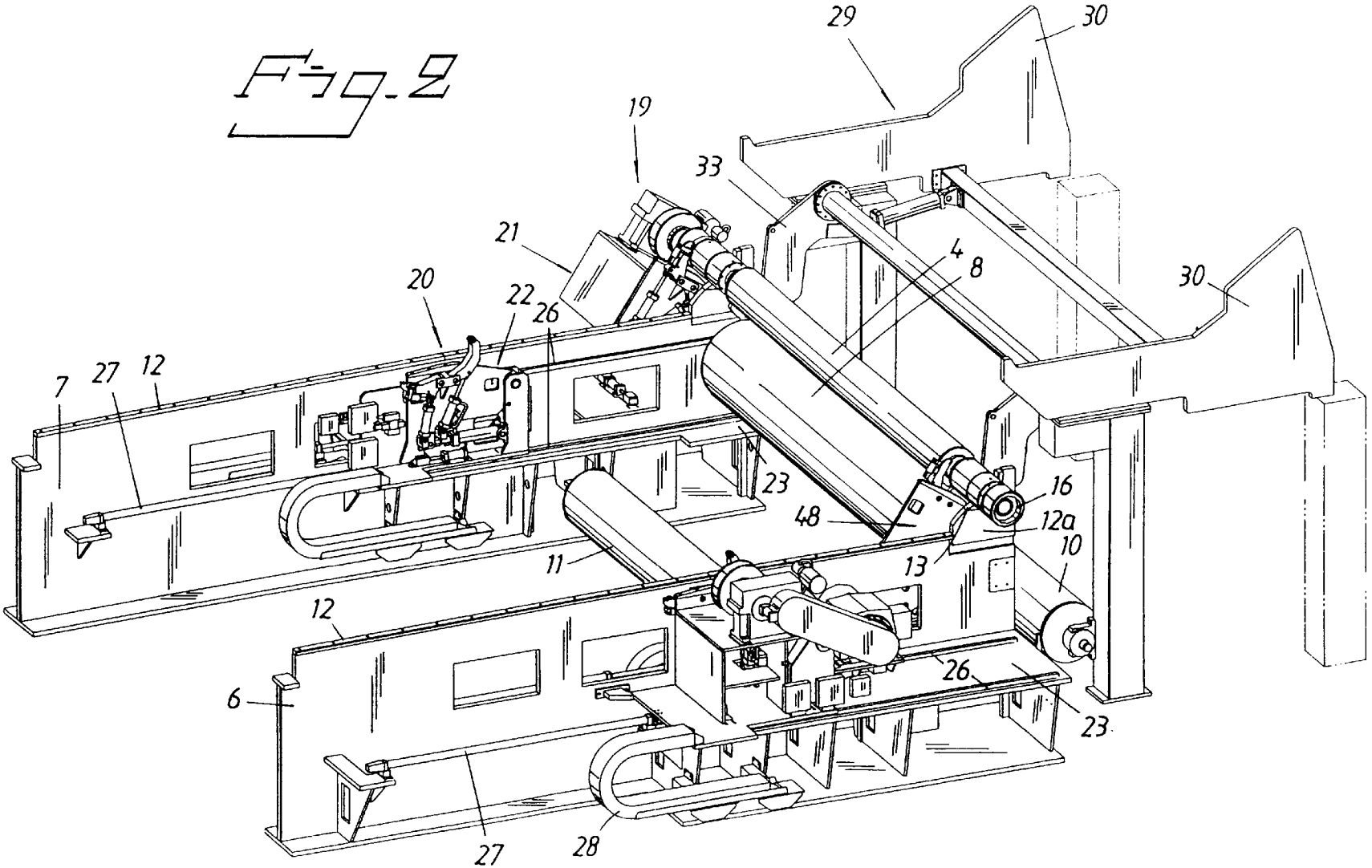
FIG. 2 is a perspective view of the reel-up according to FIG. 1.
Figure 3:
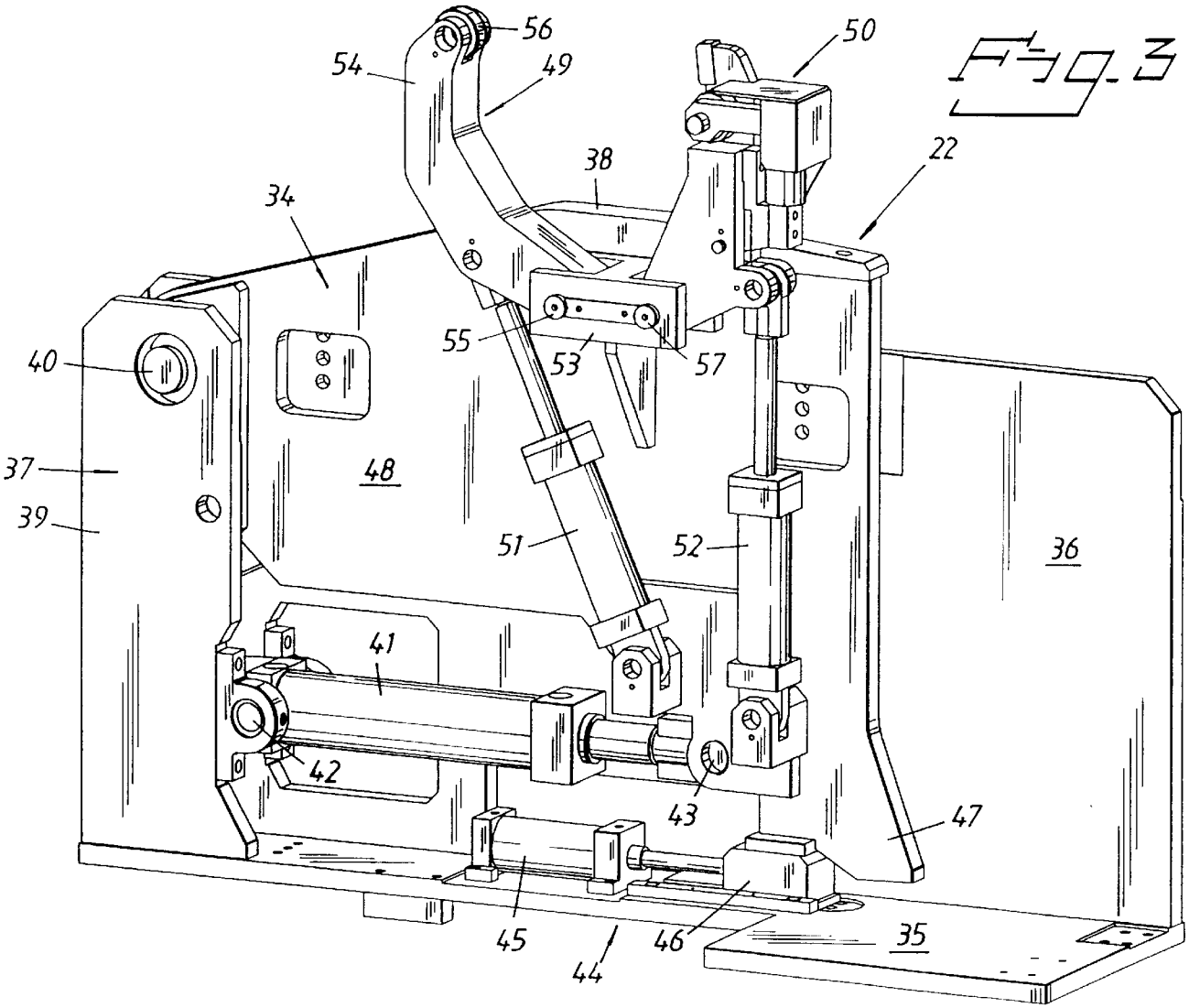
FIG. 3 is a perspective view of an inner secondary carriage of one secondary unit in the reel-up according to FIGS. 1 and 2.

FIGS. 1 and 2 show schematically parts of a reel-up 1 in a paper machine in which paper is manufactured in a continuous web 2. Paper reels 3 are reeled continuously in the reel-up 1 on a core in the form of a reeling drum 4. The reel-up 1 comprises a stand means 5 with first and second identical, elongate, parallel stand parts 6, 7. A surface winding drum 8 is rotatably journalled in the stand parts 6, 7. Over the surface winding drum 8 runs an endless belt 9 which supports the paper web 2 coming from a drying section, not shown, with a through-blow drying cylinder and/or Yankee cylinder on its way to the reel-up 1. A drive motor (not shown) gives the surface winding drum 8 a peripheral speed corresponding to that of the belt 9 and thus also the speed at which the paper web 2 is fed forward. The surface winding drum 8 may alternatively be driven by the belt 9 which runs over a plurality of rolls 10 one of which, e.g., the belt turning roll 11, is then driving.

A horizontal stand rail 12 is also rigidly mounted above each stand member 6, 7. The stand rail 12 commences with a raised portion 12*a* having a lowering surface 13 for the reeling drum 4 at the upstream end of the reel-up 1, seen in the feed direction of the paper web 2. The stand rails 12 are arranged slightly further apart from each other than the width of the paper web 2. The reeling drum 4 is provided at each end with a braking drum 14 comprising a coupling device 15 with internal toothed rim 16 and a bearing house 17 situated inside the coupling device 15. The reeling drum 4 is also provided with a groove 18 running peripherally around it for receipt of the stand rail 12 or other control element as described below.

At the upstream end of the reel-up 1, above the surface winding drum 8, is a stock 29 of empty reeling drums 4. The stock 29 comprises a substantially horizontal shelf 30 on which empty reeling drums 4 rest side by side and parallel to the surface winding drum 8, ready for use in the reel-up 1. Actuating means (not shown) comprising support arms and an actuator, such as a pneumatic or hydraulic cylinder, control the gradual forward feeding of the new reeling drums 4. An empty reeling drum 4 is transferred from the stock 29 to the lowering surfaces 13 of the stand rails 12 by a pair of lowering arms 33 when the growing paper reel 3 located downstream approaches a predetermined size. The reeling drum 4 rests with its peripheral grooves 18 on the lower surfaces 13. At the downstream end of the reel-up 1 (see FIG. 1) is a braking station 69 with a braking arm 70 in which braking station 69 the paper reel 3 is finally retarded before being transported along the stand rail 12 to a reel-handling section (not shown) of the machine.

The reel-up 1 comprises a secondary system which, in the embodiment shown in FIGS. 1 and 2, consists of a first secondary unit 19 and a second secondary unit 20, said secondary units 19, 20 being reversed in relation to each other as regards tender side and drive side. Each secondary unit 19, 20 has a first outer secondary body 21 arranged externally on the first or second stand member 6, 7, respectively, and an inner second secondary body 22 arranged internally on the second or first stand member 7, 6, respectively. Each secondary body 21, 22 is in the form of a carriage or sledge which is horizontally, linearly movably journalled on a platform 23 of the stand member 6, 7 by means of journalling means including one or more tracks, e.g., two parallel tracks 26 on the platform 23, and bearings consisting of roller or sliding bearings in the secondary carriage 22 to reduce the friction to a minimum during its to and from movements along the track or tracks 26. The inner secondary carriages 22 are also journalled in the vertical inner sides of the stand members 6, 7 by means of similar linear bearings, i.e., a track 26, which are rigidly mounted on the inner side of each stand member 6, 7, and bearings of the secondary carriage 22.

The movement of the secondary carriage 21, 22 is effected by an actuator 27, such as a pneumatic or hydraulic cylinder, attached by one end to the secondary carriage 21, 22 and by its other end to the stand member 6, 7. The movements along the guide tracks 26 of the two secondary carriages 21, 22 in one and the same secondary unit 19, 20, respectively, are synchronized with one another. Outermost on each platform 23 cables are arranged in a cable package 28 which is flexible, allowing it to follow the to and fro movements of the secondary carriage 21, 22.

Each secondary carriage 21, 22 of the reel-up 1 comprises lifting means according to a first embodiment of the present invention for lifting the reeling drum 4 from the stand rails 12 to a raised position so that the reeling drum 4 is free from the stand rails 12 and the load of the paper reel 3 and reeling drum 4 is entirely taken up by the secondary carriages 21, 22 and transferred to the stand means 5 via their journalling means. In the embodiment of the lifting means shown in FIGS. 1–5 each secondary carriage 21, 22 is provided with a pivot unit 34 for supporting cooperation with the reeling drum 4, an actuator 41 such as a pneumatic or hydraulic cylinder for turning the pivot unit 34, and a level retaining means 44 to distinctly retain the pivot unit 34 in the raised position.

Each secondary carriage 21, 22 has a bottom plate 35 with journalling elements 37 for pivotable journalling of the pivot unit 34 about an axis of pivot that is parallel with an active reeling drum 4. Each pivot unit 34 comprises a substantially rectangular, vertical support plate 48, a locking device 49, a press device 50 and actuators 51, 52 for the locking device 49 and press device 50. The press device 50 is intended to press against the bearing house 17 of the reeling drum 4 so that a predetermined linear pressure is maintained in the nip between the surface winding drum 8 and the paper reel 3 during growth of the latter. The support plate 48 is provided at its upper edge with a top rail 38 which is parallel with the stand rail 12 and arranged to cooperate with the reeling drum 4. An H-shaped connecting element 53 is rigidly mounted horizontally along one long side to the support plate 48. The locking device 49 consists of an arc-shaped locking arm 54 hinged at its lower end to the above-mentioned H-shaped connecting element 53 by a horizontal bearing pin 55 extending parallel to the central axis of the reeling drum 4, between the two legs of the H-shaped connecting element 53 arranged upstream.

The actuator 51 of the locking device 49 extends between a lower attachment point on the support plate 48 of the pivot unit 34 and the locking arm 54 and is joined to these in hinged manner at the ends. The free upper end of the locking device 49 supports a roll 56 designed to cooperate with the axis of the reeling drum 4 when the locking device 49 is in its upper production position. The press device 50 is situated immediately opposite the locking device 49 in the two legs of the H-shaped connecting element 53 and is connected therewith in hinged manner in the same way as the locking device 49. The press device 50 is also pivotably journalled by means of a bearing pin 57, influenced by an actuator 52 extending between the press device 50 and the support plate 48 of the pivot unit 34. The locking device 49 and press device 50 of the two secondary carriages 21, 22 together form a gripping device for the reeling drum 4. The reeling drum 4 is enclosed by the gripping devices 49, 50 while at the same time being freely rotatable within these throughout the entire reeling phase of the paper reel 3.

At the inner secondary part 22 (see FIG. 3), the bottom plate 35 is rectangular in shape and a vertical side plate 36 is arranged along the edge of the bottom plate 35 nearest to the stand member 6, 7. Said journalling element 37 comprises a beam 39 extending vertically up from the bottom plate 35 at the end nearest the surface winding drum 8, and a bearing pin 40 arranged at the upper end of the beam 39 and forming said axis of pivot. The pivot unit 34 is pivotable about said bearing pin 40 with the aid of the actuator 41 flexibly attached by one end to the lower end portion of the beam 39 and by its other end to the pivot unit 34 with the aid of guide pins 42, 43.

Said level retaining means 44 is arranged on the bottom plate 35 and comprises an actuator 45 and a horizontally movable level block 46 for level retaining cooperation with a stepped level shoulder 47 on the pivot unit 34. Since the level block 46 of the level retaining means 44 can be set in two positions by means of the actuator 45, the vertical position of the pivot unit 34 can be set in an upper production position where the ends of the reeling drum 4 rest with their bearing house 17 on the top rail 38 of each pivot unit 34, and a lower position where said top rail 38 on its pivot unit 34 is at a level below the upper edge of the stand rail 12. When the pivot units 34 of one of the secondary units 19 or 20 are in this lower return position and the pivot units 34 of the other secondary unit 20 or 19 are in their upper production position, the secondary carriages 21, 22 can pass pairwise under each other. In other words, the secondary unit 19 or 20 which has delivered a finished paper reel 3 downstream can pass below the paper reel 3 in the process of being formed in the other secondary unit 20, 19, respectively. The reeling drum 4 which is in the production position is then raised from the stand rail 12.

Figure 4:
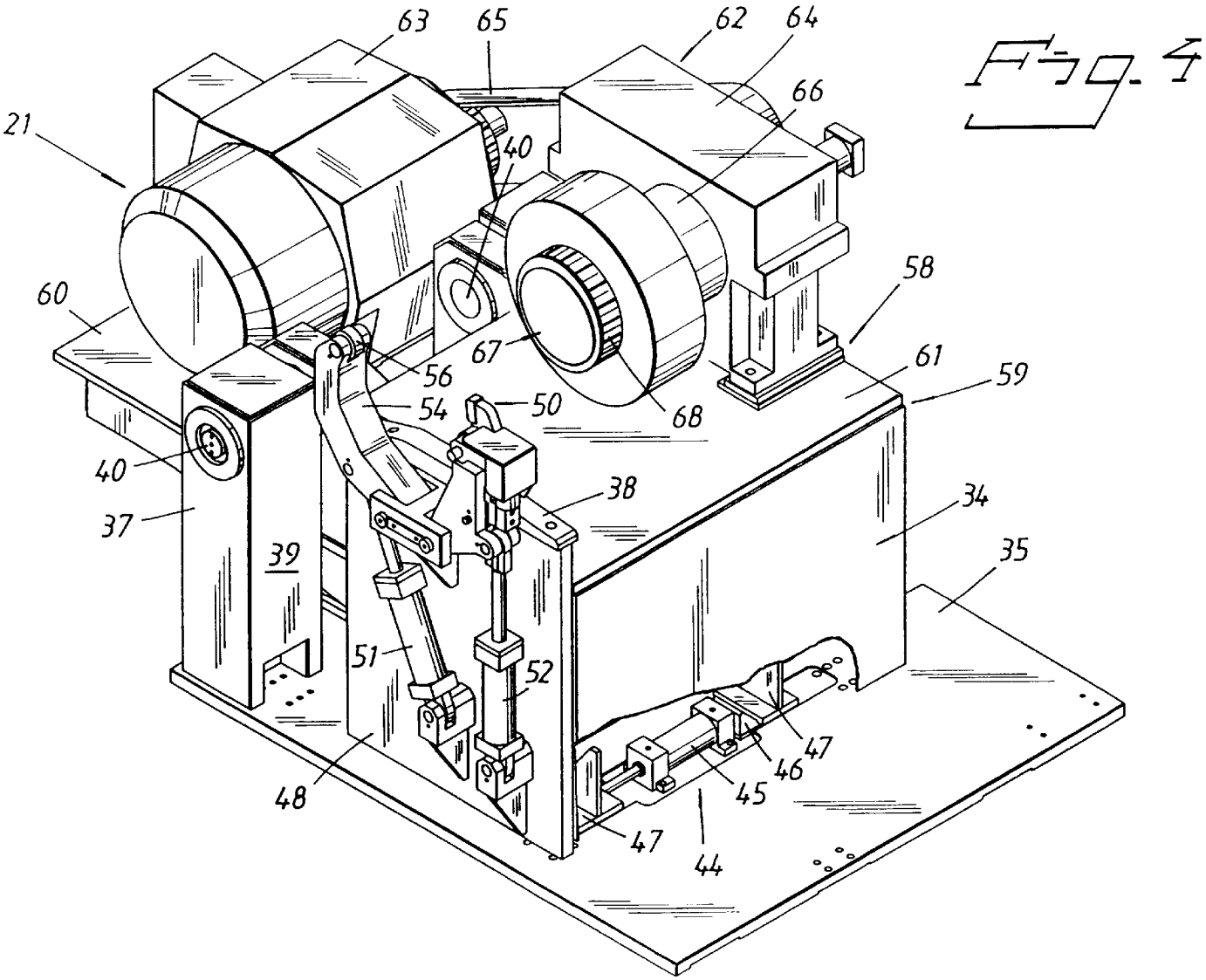
FIG. 4 is a perspective view of an outer secondary part of one secondary unit in the reel-up according to FIGS. 1 and 2, with a part of the box part removed.
Figure 5:
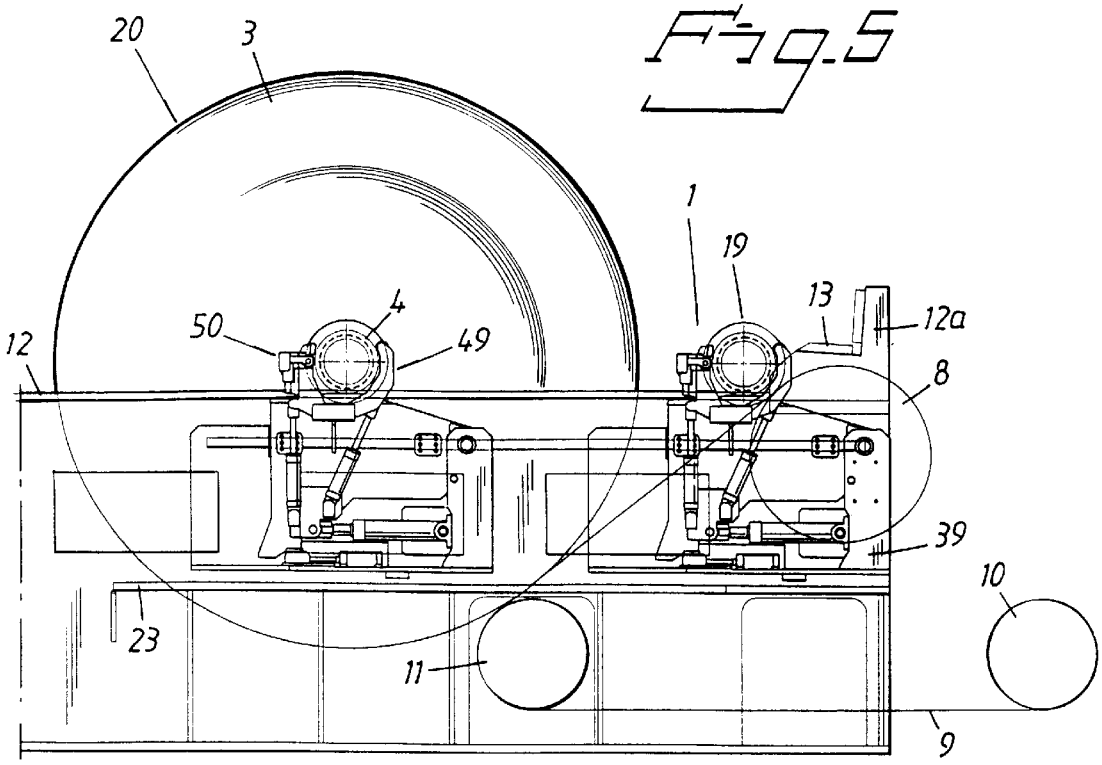
FIG. 5 is a side view of the upstream part of the reel-up according to FIG. 1 and illustrates one operating position during the reeling process.

The outer secondary carriage 21 of each secondary unit 19, 20 is described in more detail with reference to FIG. 4, the same reference designations being used for equivalent construction elements with respect to the inner secondary carriage described above. The outer secondary carriage 21 has a bottom plate 35 which is somewhat larger than that of the inner secondary carriage 22. The journalling element 37 for pivotable journalling of the pivot unit 34 about a bearing shaft comprises two vertical beams 39, each arranged at one edge extending parallel to the stand member 6, 7, and two bearing pins 40 arranged at the upper end parts of the beams 39 and forming said bearing shaft for the pivot unit 34. Said level retaining means 44 has its actuator 45 arranged horizontally at right angles to the stand member 6, 7. The pivot unit 34 comprises a stand 58 with a box-shaped part 59 and a platform 60 projecting therefrom. The box part 59 is provided with an upper horizontal plate 61 on which parts of a means 62 for central driving of the reeling drum 4 are arranged. Said vertical lifting plate 48 is here rigidly mounted to the inner vertical wall of said box part 59 forming a part of the pivotable stand 58. Since the central drive means 62 is rigidly mounted on the pivot unit 34 it is linearly displaceable together with the secondary carriage 21 in a direction parallel to the stand rails 12 and also pivotably together with the pivot unit 34.

The central drive means 62 comprises a drive motor 63 firmly rigidly mounted on the platform 60, a transmission box 64 rigidly mounted to the box part 59 and a power transmission 65 arranged between them which, in the embodiment shown, consists of a tooth belt. A rotatable shaft 66 projects from the transmission box 64 in a direction parallel to the reeling drum 4. A coupling device 67 is arranged on this shaft 66 at its inner end facing the stand member 6, 7. The coupling device 67 has an external toothed rim 68 designed to cooperate with a corresponding internal toothed rim 16 on the reeling drum 4. This cooperation between the two coupling devices 15, 67 is achieved by the coupling device 67 of the central drive means 62 being displaced coaxially in relation to the coupling device 15 until connection occurs.

As can be seen in FIGS. 1 and 2, each pivot unit 34 of a secondary unit 19, 20 is also arranged to be turned past the stand rails 12 up to an upper fetching position for receipt of an empty reeling drum 4 which has been deposited on the lowering surfaces 13 to be carried thereafter by the top rails 38 of the pivot units 34 when the pivot units 34 are turned back. This turning is taken care of by the actuator 41.

Unless the reeling drum 4 with the associated growing paper reel 3 must be lowered to the stand rails 12 for reasons of safety or for some other reason, it is advantageous for the reeling drum 4 and paper reel 3 to be carried by the secondary carriages 21, 22 via their top rails 38 through the whole production phase from empty, or substantially empty reeling drum 4 to finished paper reel 3, after which the reeling drum 4 with finished paper reel 3 is lowered to the stand rails 12.

Figure 6:
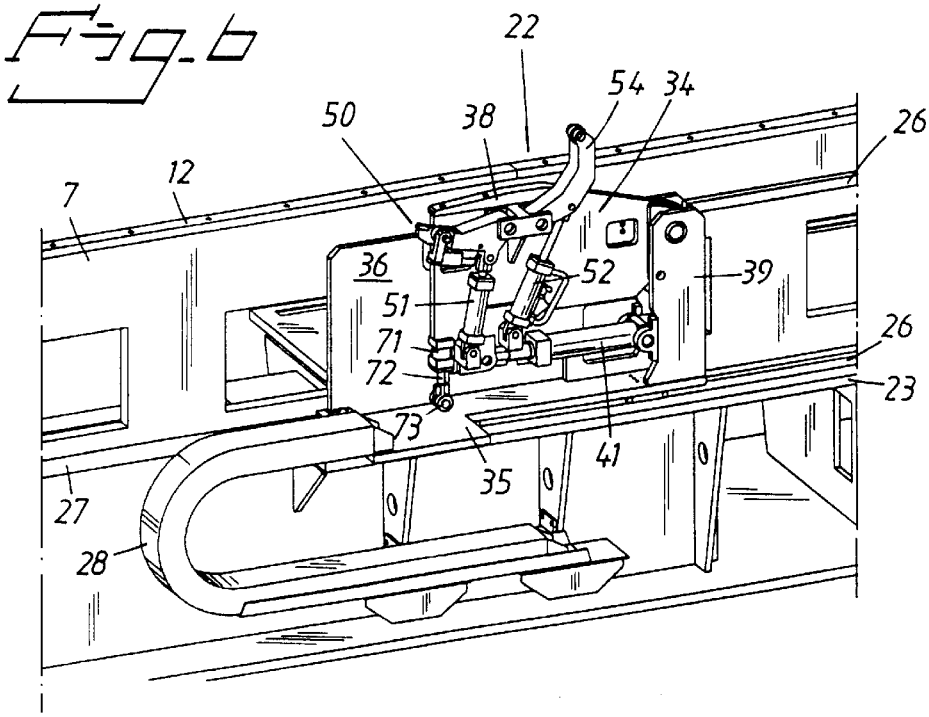
FIGS. 6 and 7 are perspective views of part of a reel-up similar to that shown in FIG. 1, but provided with lifting means according to a second embodiment of the invention.
Figure 7:
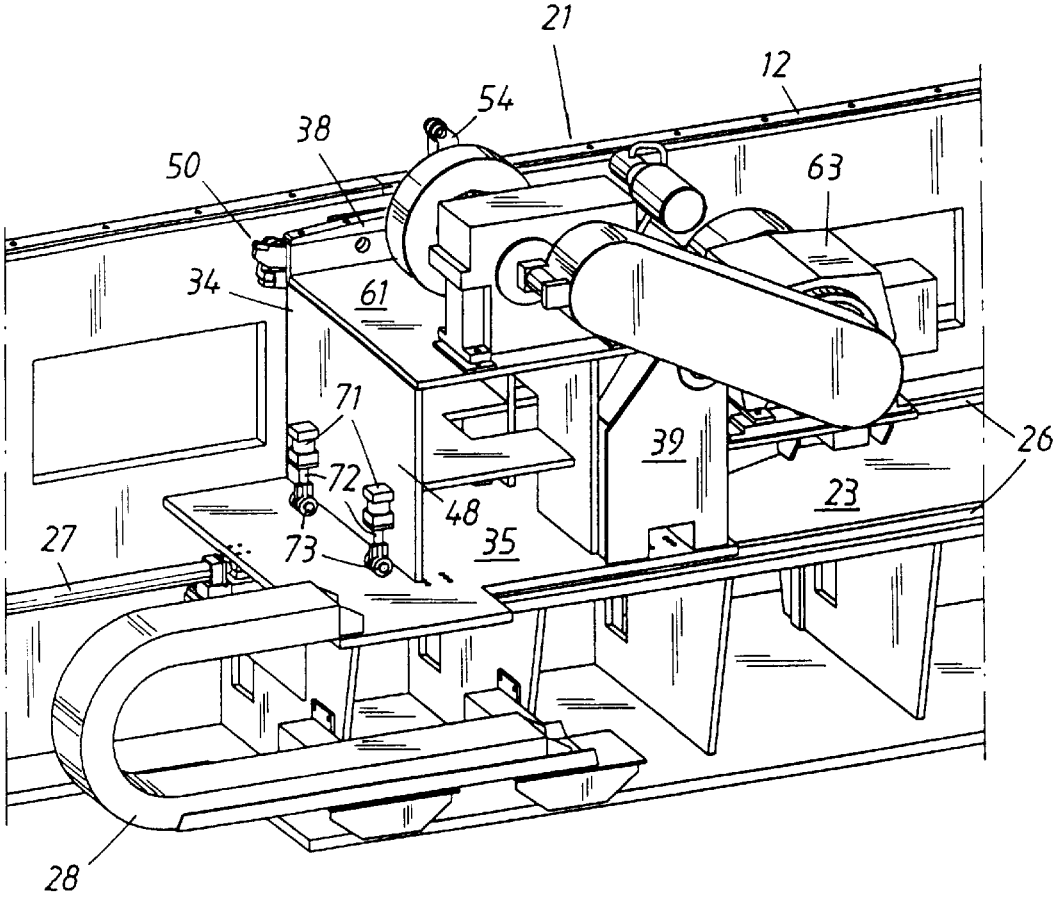
Figure 8:
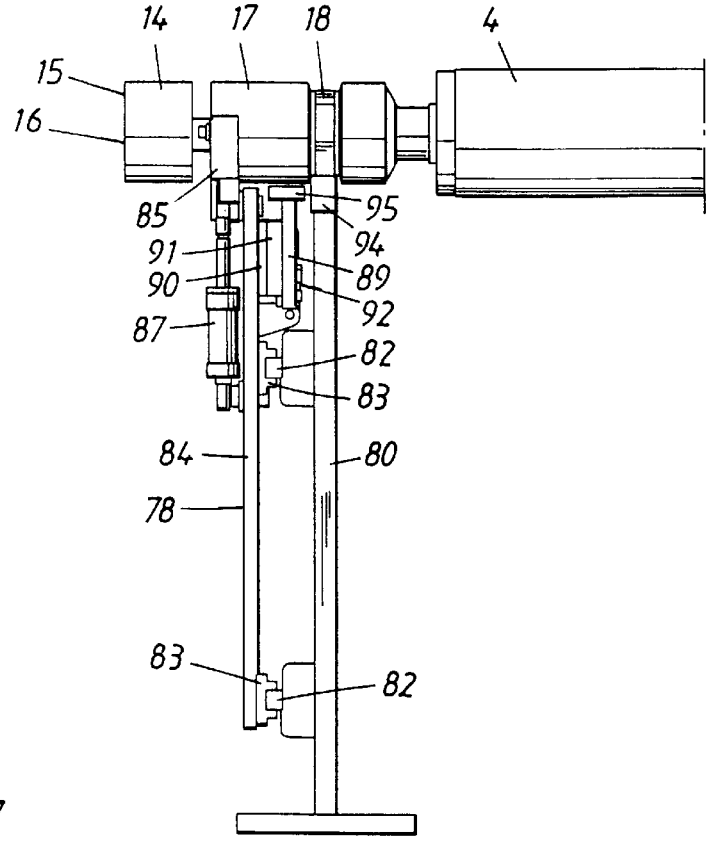
FIG. 8 is a cross-sectional view of a first stand member and secondary carriage in a reel-up of the type having a secondary unit, the secondary carriages of which are provided with lifting means according to a third embodiment of the invention, with the lifting means in inoperative position.
Figure 9:
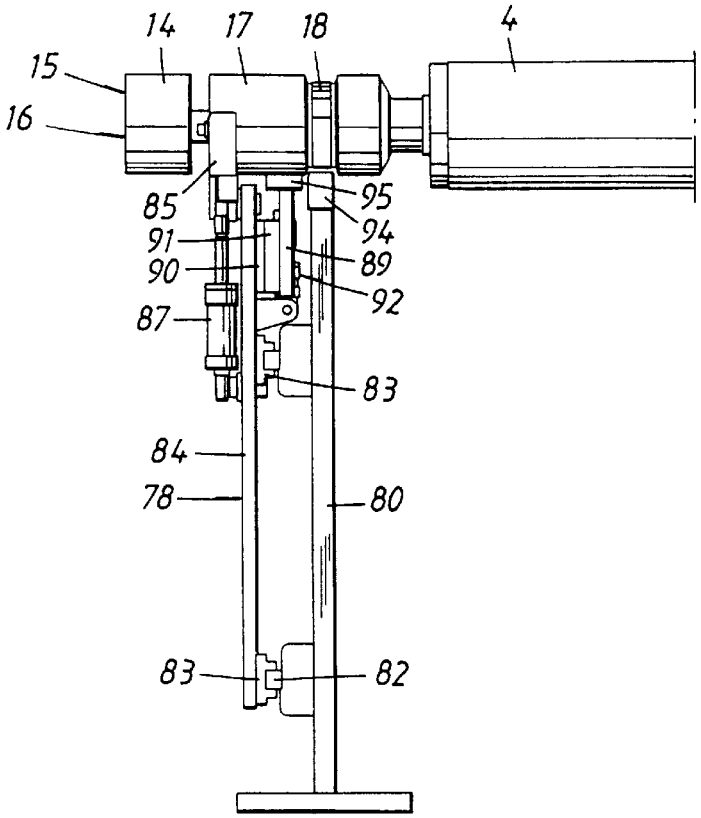
FIG. 9 shows the same as FIG. 8 but with the lifting means in operative position.
Figure 10:
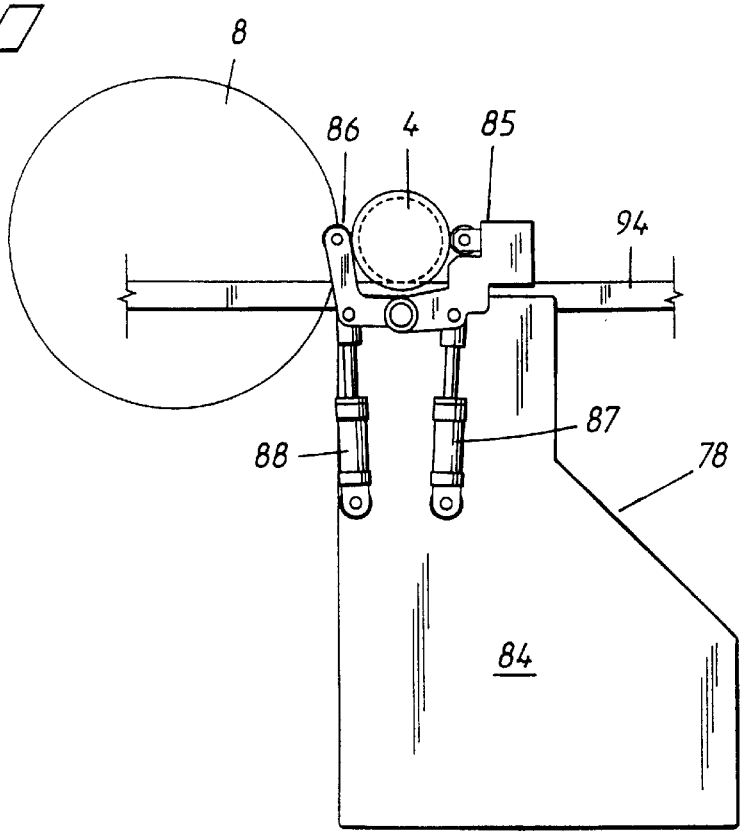
FIG. 10 is a view of the secondary carriage according to FIG. 8 seen from the outside.
Figure 11:
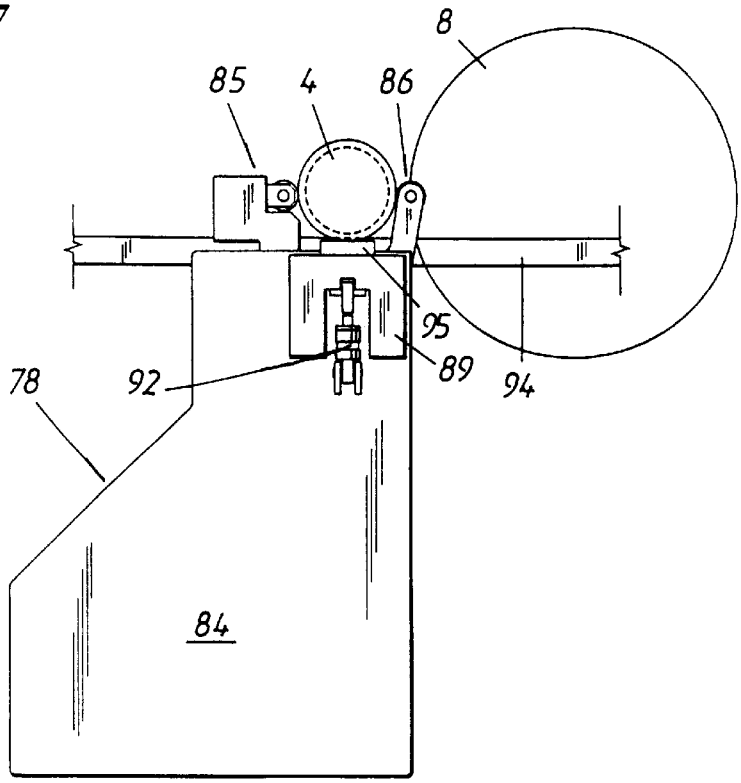
FIG. 11 is a view of the secondary carriage according to FIG. 9 seen from the inside.
Figure 12:
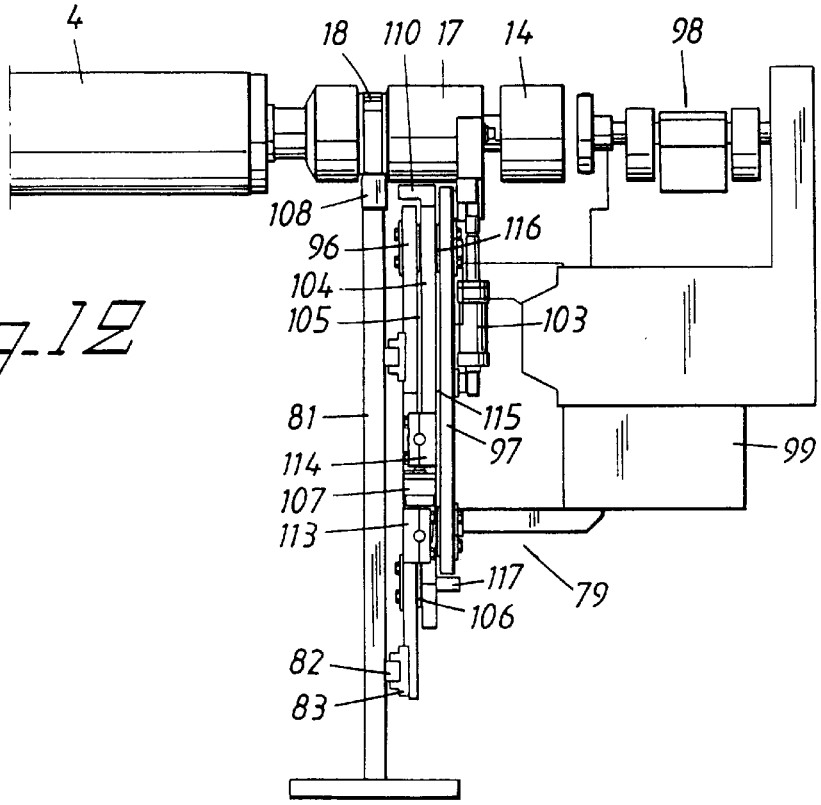
FIG. 12 is a cross-sectional view of a second stand member and secondary carriage of the reel-up according to FIG. 8, said second secondary carriage being provided with equipment for central driving, with the lifting means in inoperative position.
Figure 13:
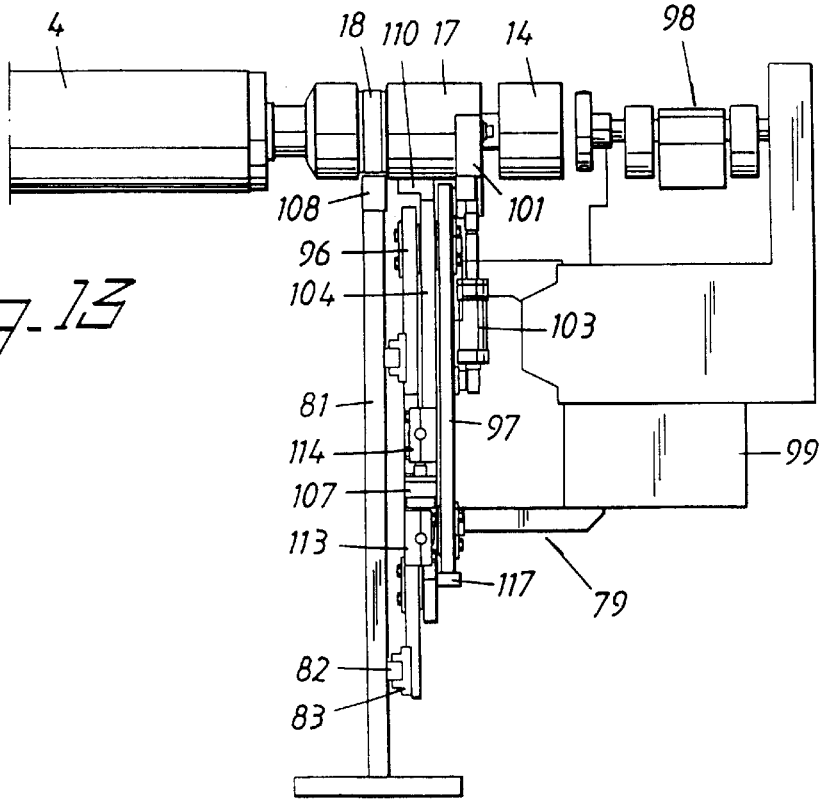
FIG. 13 shows the same as FIG. 12 but with the lifting means in operative position.
Figure 14:
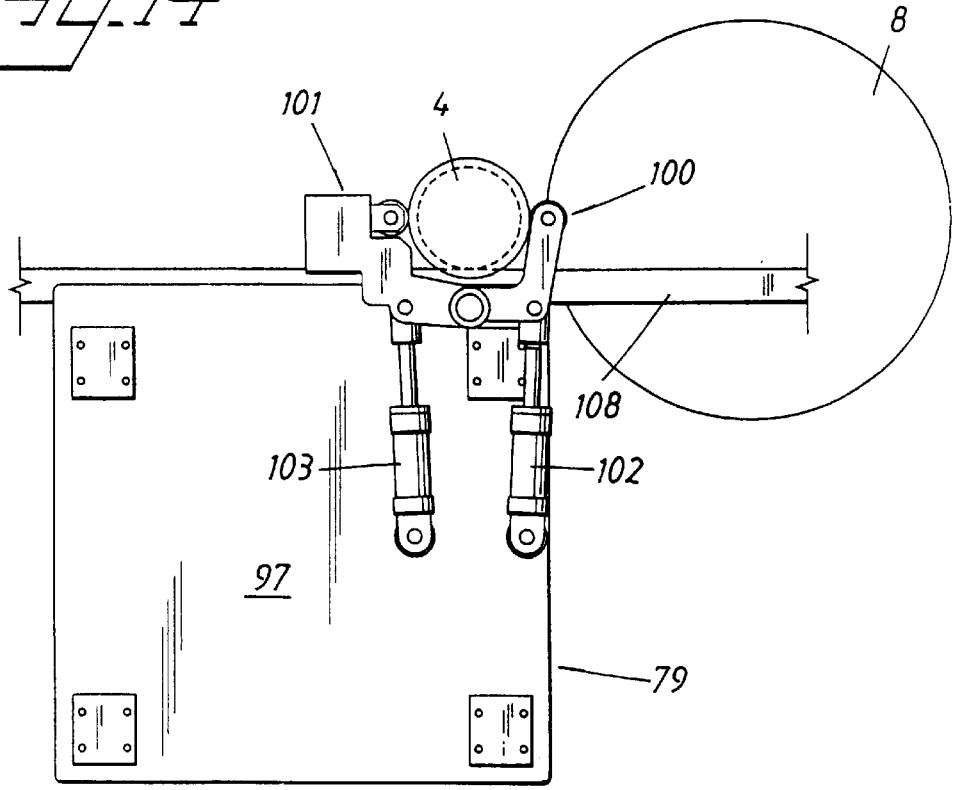
FIG. 14 is a side view of an outer support plate of the second secondary carriage according to FIG. 12.
Figure 15:
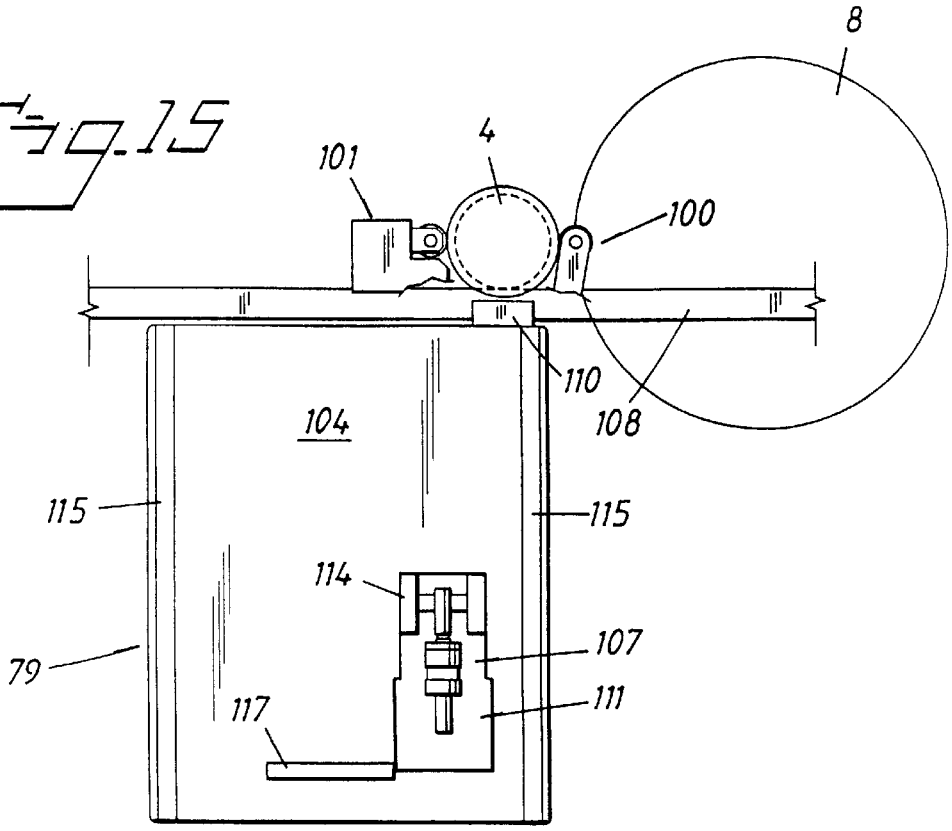
FIG. 15 is a side view of the lifting means of the second secondary carriage according to FIG. 12.
Figure 1B:
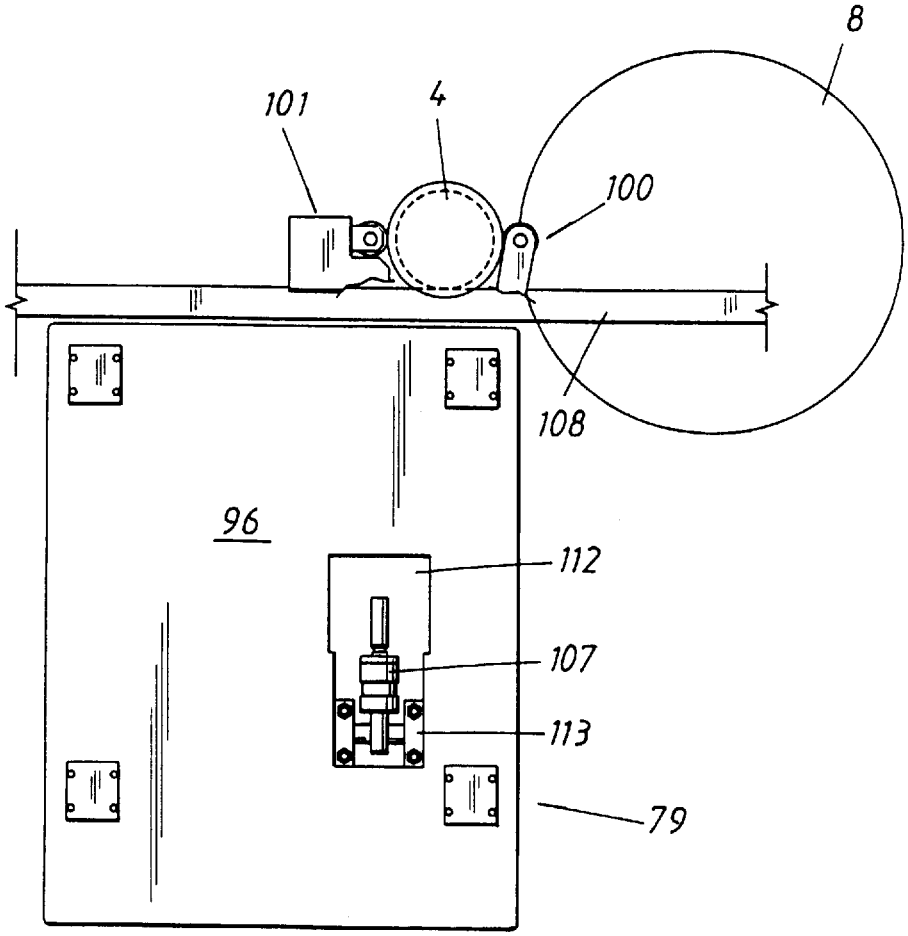

FIGS. 6 and 7 show parts of a reel-up similar to that described with reference to FIGS. 1–5, but provided with lifting means in accordance with a second embodiment of the invention. The lifting means comprises an actuator 41 pivotable by means of a pivot unit 34 in accordance with the first embodiment. However, it is provided with a level retaining means 44 of a different type. In the inner secondary carriage 22 shown in FIG. 6, the level retaining means 44 comprises an actuator 71 in the form of a pneumatic or hydraulic cylinder. The cylinder 71 is vertically rigidly mounted to the lifting plate 48 and its piston rod 72 is directed downwards, said piston rod 72 carrying a pivotable pulley 73 for cooperation with the bottom plate 35. When the cylinder 71 is activated the piston rod 72 assumes an extended position, whereupon the pulley 73 rests against the bottom plate 35 so that the reeling drum 4 is distinctly retained at a level immediately above the stand rail 12 as described earlier.

In the outer secondary carriage 21 shown in FIG. 7 two vertical actuators 71 of the type described are used to distinctly retain the reeling drum 4 at its upper level immediately above the stand rail 12. The vertical actuators 71 described may also be used to turn the pivot unit 34 from the lower position, when the pivot unit 34 suitably rests on the bottom plate 35, to the upper position when the top rail 38 is located at a level somewhat above the stand rails 12 so that the reeling drum 4 is free from the latter. Alternatively the pulley 73 may be replaced by a block which is rigidly mounted to the end of the piston rod and suitably has a rounded support surface.

FIGS. 8–16 show schematically parts of a reel-up of a different type from that described above. This type of reel-up comprises a primary system (not shown) and a secondary system comprising first and second secondary carriages 78, 79 arranged on the outer sides of two parallel stand members 80, 81 similar to those described above. Such a reel-up is described, for instance, in SE-B-469 071 (corresponding to U.S. Pat. No. 5,375,790). Each secondary carriage 78, 79 is linearly movably journalled on the outside of its stand member 80, 81 by means of journalling means comprising two parallel tracks 82 and bearings 83, e.g., roller or sliding bearings. Each secondary carriage 78, 79 is moved to and from by means of a suitable actuator (not shown).

In the embodiment of the first secondary carriage 78 shown in FIGS. 8–11 the lifting means according to a third embodiment of the invention is arranged on the inner side of a vertical support plate 84 on the first secondary carriage 78. A press device 85 and locking device 86 with actuators 87, 88 as described above in connection with the reel-up according to FIGS. 1–5 are located on the outside of the support plate 84. The lifting means comprises a lifting plate 89 which is linearly movably journalled in the support plate 84 by journalling means comprising two vertical tracks 90 mounted on the support plate 84, and opposite bearings 91 which may consists of roller or sliding bearings, on the lifting plate 89. The lifting means is also provided with an actuator 92, such as a pneumatic or hydraulic cylinder, for moving the lifting plate 89 up and down.

The actuator 92 also has the function of level retaining means to distinctly retain the lifting plate 89 in the raised position when the reeling drum 4 is free from the stand rail 94. The lifting plate 89 is provided with a relatively short top rail 95 which is rigidly mounted to the upper edge of the lifting plate 89 and has a flat horizontal support surface which is brought into contact with the reeling drum 4 from below. The lifting plate 89 is shaped like an inverted U with the actuator 92 extending between its shanks.

The second secondary carriage 79, shown in more detail in FIGS. 12–16, also includes means 98 for central driving of the reeling drum 4. The secondary carriage 79 has an inner support plate 96 by means of which the secondary carriage 79 is linearly movably journalled to its stand member 81 in the same way as described above for the first secondary carriage 78. The secondary carriage 79 also has an outer support plate 97 carrying the central drive means 98 via a stand 99, as well as a locking device 100 and a press device 101 with associated actuators 102, 103 of the same type as described above for the first secondary carriage 78. The lifting means is arranged between the inner and outer support plates 96, 97 and comprises a lifting plate 104 which is linearly movably journalled to the inner support plate 96 by journalling means comprising two vertical tracks 105 rigidly mounted on the inner support plate 96 and opposite, cooperating bearings 106, consisting of roller or sliding bearings, on the lifting plate 104.

The lifting means is also provided with an actuator 107, such as a pneumatic or hydraulic cylinder, for moving the lifting plate 104 up and down, whereupon the actuator 107 also functions as level retaining means to distinctly retain the lifting plate 104 in the raised position when the reeling drum 4 is free from the stand rail 108. The lifting plate carries a relatively short top rail 110 which is rigidly mounted to the upper edge of the lifting plate 104 and has a flat horizontal support surface which is brought into contact with the reeling drum 4 from below. As is more easily seen in FIGS. 15 and 16, the lifting plate 104 and the inner support plate 96 are provided with apertures 111, 112 for mounting of the actuator 107, the lower end thereof being attached to the inner support plate 96 and the upper end to the lifting plate 104 by means of lower and upper attachments 113, 114.

The outer support plate 97 is vertically linearly movably journalled on the lifting plate 104 by means of journalling means comprising vertical guide tracks 115 mounted on the lifting plate 104, and opposing bearings 116, consisting of roller or sliding bearings, on the outer support plate 97 A stop (not shown) is arranged to fix the outer support plate 97 in a lower position when the reeling drum 4 rests on the rails 94, 108, in which case the outer support plate 97 is situated with its upper edge a predetermined distance from the reeling drum 4. The lifting plate 104 is provided at its lower end and on its outer side, with a boss-shaped follower 117 for cooperation with the outer support plate 97 so that a small space is formed between the follower 117 and the lower edge of the outer support plate 97 when the outer support plate 97 is in said lower position and when the reeling drum 4 rests on the stand rail 108. This space is as great as the space between the top rail 110 of the lifting plate 104 and the reeling drum 4. When the actuator 107 is activated the lifting plate 104 is moved upwards and will then lift the reeling drum 4 at the same time as the follower 117 is brought into engagement with the outer support plate 97 and lifts this a corresponding distance so that the central axis of the central drive means 98 is kept in line with the central axis of the reeling drum 4.

In a reel-up in particular with secondary carriages according to FIGS. 1–7, embodiments of the lifting means other than those shown here can be used. The lifting means may, for instance, comprise a wedge-shaped level block which is horizontally displaceable in order to raise and lower the pivot unit, or a pivotable eccentric device, the eccentric peripheral surface of which raises and lowers the pivot unit by means of turning, or a suitable screw means.

The distance between the stand rails 12 and the reeling drum 4 in its said raised production position is the same at both stand rails 12 and is at least 1 mm, preferably at least 2 mm. It is preferred that the support surface of the top rail 38 is flat and horizontal.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A reel-up in a paper machine in which paper is produced in a continuous web and reeled up on reeling drums to form paper reels, said reel-up comprising:

two elongate parallel stand members each having an upstream end, a downstream end and an upper edge extending therebetween;

a moving winding surface arranged at the upstream ends of the stand members to carry the web and deliver the web to a reeling drum;

a primary device for moving an empty reeling drum to a position adjacent to the parallel stand members to commence a reeling operation; and a pair of secondary members for receiving the reeling drum from said primary device and engaging the reeling drum against the winding surface to wind the web onto the reeling drum, each of said secondary members being mounted for linear movement adjacent to a respective stand member such that the secondary members are moved away from the winding surface as the reel grows in diameter, said secondary members each comprising;

a reeling drum support member mounted for upward movement, and an actuator for moving said reeling drum support member upwardly relative to the respective stand member to a raised production position for supporting the reeling drum above the upper edge of said stand member as the web is wound onto the reeling drum.

2. A reel-up as claimed in claim 1 wherein the distances between the upper edge of a stand member and the reeling drum when supported in the raised production position is the same for both stand members and are at least 1 mm.

3. A reel-up as claimed in claim 2 wherein the distances between the upper edges of the stand members and the reeling drum when supported in the raised production position are at least 2 mm.

4. A reel-up as claimed in claim 1 wherein said reeling drum support members each comprise a top rail which is flat and horizontal.

5. A reel-up as claimed in claim 4 wherein said top rails of said reeling drum support members are substantially parallel with the upper edges of the stand members.

6. A reel-up as claimed in claim 1 wherein the secondary members each comprise a level retaining means to positively engage and distinctly retain the reeling drum in the production position once raised by the actuator.

7. A reel-up as claimed in claim 1 wherein each reeling drum support member is supported on a vertically extending lifting plate which is pivotably journalled relative to the respective actuator so as to be pivoted upward to support the reeling drum above the stand member.

8. A reel-up as claimed in claim 7 wherein said secondary members each further comprise a bottom plate on which the lifting plate is pivotably journalled.

9. A reel-up as claimed in claim 8 further comprising a level retaining means including a level block journalled on the bottom plate for being displaced under the lifting plate and for distinctly retaining the reeling drum in its raised production position.

10. A reel-up as claimed in claim 8 further comprising a level retaining means including at least one vertically arranged actuator configured to cooperate with the lifting plate and the bottom plate in order to support the reeling drum in the raised production position.

11. A reel-up as claimed in claim 1 wherein said actuator comprises a pivotably journalled eccentric device arranged to lift the support member.

12. A reel-up as claimed in claim 1 wherein said actuator comprises a screw device.

13. A reel-up as claimed in claim 1 further comprising a horizontal platform connected to each of the stand members on which the secondary members are mounted for translational movement.

14. A reel-up as claimed in claim 1 wherein said reeling drum support members each comprise a vertical lifting plate which is mounted for vertical linear displacement.

15. A reel-up in a paper machine in which paper is produced in a continuous web and reeled up on reeling drums to form paper reels, said reel-up comprising:

two elongate parallel stand members each having an upstream end, a downstream end and an upper edge extending therebetween;

a moving winding surface arranged at the upstream ends of the stand members to carry the web and deliver the web to a reeling drum;

a primary device for moving an empty reeling drum to a position adjacent to the parallel stand members to commence a reeling operation; and a pair of secondary members for receiving the reeling drum from said primary device and engaging the reeling drum against the winding surface to wind the web onto the reeling drum, said secondary members each comprising;

a support carriage adjacent to a respective stand member;

a linear actuator for linearly moving the support carriage in a direction parallel to the stand member;

a reeling drum support member pivotally supported on said support carriage for engaging an end of an empty reeling drum and pressing the reeling drum against the winding surface; and an actuator for pivoting the reeling drum support member between a fetching position folded away from the support carriage for collection of an empty reeling drum and a production position folded towards the support carriage where the collected reeling drum is supported above the upper edge of said stand member as the web is wound onto the reeling drum.

16. A reel-up as claimed in claim 15 wherein said reeling drum support members each comprise a top rail which is flat and horizontal.

17. A reel-up as claimed in claim 16 wherein each top rail is supported on a vertically extending lifting plate which is pivotably journalled relative to the actuator so as to be pivoted upward to support the reeling drum above the stand member.

18. A reel-up as claimed in claim 17 wherein said secondary members each further comprise a bottom plate on which the lifting plate is pivotably journalled.

19. A reel-up as claimed in claim 18 further comprising a level retaining means including a level block journalled on the bottom plate for being displaced under the lifting plate and for distinctly retaining the reeling drum in its raised production position, and an actuator to effect displacement of the level block.

20. A reel-up as claimed in claim 15 wherein said reeling drum support members each further comprise a press device and a locking device for securely engaging an end of the reeling drum.

21. A reel-up as claimed in claim 15 further comprising a horizontal platform connected to each of the stand members on which the support carriages are mounted for translational movement.

22. A secondary member for receiving one end of a reeling drum in a reel-up having a pair of elongate stand members, said secondary member comprising:

a support carriage adjacent to a respective stand member;

a linear actuator for linearly moving the support carriage in a direction parallel to the stand member;

a reeling drum support member pivotally supported on said support carriage for engaging an end of an empty reeling drum; and an actuator for pivoting the reeling drum support member between a fetching position folded away from the support carriage for collection of an empty reeling drum and a production position folded towards the support carriage where the collected reeling drum is supported above the upper edge of the stand member as the web is wound onto the reeling drum.

23. A secondary member as claimed in claim 22 wherein said reeling drum support member comprises a top rail which is flat and horizontal.

24. A secondary member as claimed in claim 23 wherein said top rail is supported on a vertically extending lifting plate which is pivotably journalled relative to the actuator so as to be pivoted upward to support the reeling drum above the stand member.

25. A secondary member as claimed in claim 24 wherein said secondary members each further comprise a bottom plate on which the lifting plate is pivotably journalled.

26. A secondary member as claimed in claim 25 further comprising a level retaining means including a level block journalled on the bottom plate for being displaced under the lifting plate and for distinctly retaining the reeling drum in its raised production position.

27. A secondary member as claimed in claim 22 wherein said reeling drum support member further comprises a press device and a locking device for securely engaging an end of the reeling drum.

* * * * *